United States Patent [19]

Stern et al.

[11] 4,444,192

[45] Apr. 24, 1984

[54] BRASSIERE

[75] Inventors: Harold Stern, Wyckoff, N.J.; Elisabeth Suleiman, Newark, Del.

[73] Assignee: International Playtex, Inc., Stamford, Conn.

[21] Appl. No.: 464,074

[22] Filed: Feb. 4, 1983

Related U.S. Application Data

[63] Continuation-in-part of Ser. No. 269,916, Jun. 2, 1981, Pat. No. 4,372,322.

[51] Int. Cl.[3] ..... A41C 3/00

[52] U.S. Cl. ..... 128/491; 128/498

[58] Field of Search ..... 128/498, 489, 490, 491

[56] References Cited

U.S. PATENT DOCUMENTS

| | | | |
|---|---|---|---|
| 1,882,023 | 10/1932 | Malnick | 128/491 |
| 3,699,971 | 10/1974 | Hittel et al. | 128/491 |
| 4,372,322 | 2/1983 | Stern et al. | 128/491 |

*Primary Examiner*—Doris L. Troutman

*Attorney, Agent, or Firm*—Stewart J. Fried

[57] ABSTRACT

A brassiere having cups supported on their bottom by a non-distensible frame panel connected to the bottom of the cup and supported on the inner and outer top sides by a multi-directional stretchable frame connected to the cup by a narrow transition panel. The frame is cut to provide maximum stretch along the outer edge of the cup, and maximum stretch traverse to the inner edge of the cup. The transition panel has an open pattern and is hingable about an axis parallel to the edge of the cup.

29 Claims, 6 Drawing Figures

BRASSIERE

BACKGROUND OF THE INVENTION

This invention is a continuation-in-part of the patent application filed June 2, 1981, Ser. No. 269,916 now U.S. Pat. No. 4,372,322.

The present invention relates generally to brassieres and more particularly to a brassiere constructed to increase comfort by individual adjustability while providing support.

In U.S. Pat. No. 3,699,971 issued Oct. 24, 1972 to William C. Hittel et al and assigned to the assignee of the present invention, there is disclosed a brassiere, the cups of which are framed by distensible inner, outer and under bust panels. As discussed in the Hittel patent, the foundation garments have been standardized using a numerical notation for the girth size and an alphabetic notation for the bust cup size. However, it is recognized that both the girth of the female dorsal at the bust and the volumetric capacity of the bust vary or change within each class of standardized size designation as well as varying for a given woman in response to body breathing, movement, and to a certain extent, depending upon the given time of the month with respect to the woman's menstrual cycle.

To accommodate for these variations in girth size and volumetric capacity, the Hittel et al patent provided a three panel frame for the cup with the top inner and outer panels being stretchable. The distensible frame panels of the brassiere permit ease of breathing, movement and advantageously tend to be non-restrictive in the critical anatomical areas, for example, along the outer side edge of the cups which is the area of blood supply to the breasts. The distensibility of the various frame members also dissipates the various forces applied to the garment during the movement of the wearer and particularly the vertical forces which are especially acute along the outer edges during the lifting of the arms. By use of individual panels, the direction of distensibility can be controlled along each edge of the cups by the separate and distinct panels. The inner panels provide stretch along a line traverse to the cup edge with no stretch parallel to the cup edge. The outer panel primarily is stretched along an axis parallel to the edge of the cup.

The inner and outer top panels are seamed together above the top or apex of the cup. This joinder effectively eliminates distensibility at the top edge of the cup and provides support for the cup. Thus the forces that are relieved by the framing elements are transmitted through this non-distensible area to the edge of the cup and cause an acute transition between the cup and the frame.

The elasticity of the frame of some brassieres are not sufficiently controlled and thus do not provide sufficient support for the breasts. Since the weight of the breasts is concentrated along the lower section of the cup, the cup is urged downward. With the cup projecting outward of the body, this downward force is experienced in the lower cup area not only as a vertical downward force but also as a horizontal force across the curvature of the cup. Thus, in U.S. Pat. No. 3,896,818, issued on July 29, 1975 to Jack J. Locascio and assigned to the assignee of the present invention, means are provided to selectively restrict certain areas of the cup frame and through the implementation of the selective restriction provide a construction which enables variation in the shape of the cup perimeter while maintaining the appropriate support. The restriction is produced by adding an overlapping panel to selectively restrict the vertical distensibility of the inner panels as they extend along the upper inner edge of each of the cups and restrict horizontal distensibility of the inner panel between the cups. Although Locascio has provided an improvement in support, the edges of the base of the cup are not isolated from the frame and thus forces applied to the brassiere cause the cups to move and have an acute transition with the frame.

Efforts to isolate the cup from the tensions of the yoke or periphery of the brassiere have included attaching the cup to a multi-directional distensible material. For example, in the West German Offenlegungsschrift 2,438,089 issued Feb. 19, 1976, the cup 6 is surrounded from the front central seam to the back with a single piece of multi-directional stretchable material 3,4. Since the body-encompassing portion or dorsal portion is unitary with the cup framing portion, and the major direction of stretch is selected for expansion horizontally because of the dorsal panel, the appropriate direction of stretch and support along the frame portion of the cup is not provided.

Another attempt to isolate the cup from the framing yoke is illustrated in U.S. Pat. No. 3,192,929 to Guberman issued July 6, 1965. Each cup is attached to an inverted U-shape elastic member 11 which is seamed about its periphery to a non-distensible yoke 2. The frame is surrounded on its periphery by non-elastic tapes 4,5 and 6. Although Guberman provides an isolation frame material 11, it required the second non-distensible material or yoke 2 to provide the appropriate support with the non-elastic tapes 4,5 and 6. The dimension and positioning of the framing elements 11, although isolating the cup, does not provide sufficient support as described above. Also, the non-distensible yoke 2 provides a restriction along the upper, inner and outer edges of the breasts which is undesirable as indicated previously.

Thus, it can be seen that the prior art is concerned with optimizing support and comfort and has continued to design brassieres for different segments of users which stress one of these over the other.

SUMMARY OF THE INVENTION

An object of the present invention is to provide a brassiere which provides finer balance of support and comfort than prior art brassieres.

Another object of the present invention is to provide a brassiere with a frame which isolates the cups from each other to allow individual adjustability while providing support.

Still another object of the present invention is to provide an adaptable brassiere which allows each cup to separately fit the wearer and adjust naturally to cyclic anatomical variations.

A further object of the present invention is to provide a brassiere which provides support while allowing each cup to individually fit the wearers having different amounts of separation between breasts.

Still another object of the present invention is to provide a brassiere having a cup frame which isolates the cup from the peripheral yoke while providing appropriate support for the cup.

Still another object of the present invention is to provide a support frame for a substantially non-distensible brassiere cup which provides support as well as isolation.

These and other objects of the present invention are attained by providing a non-distensible bottom frame portion connected to the bottom of the cup to restrict vertical and horizontal movement of the bottom of the cup and a plurality of multi-directional stretchable frame panels along the inner and outer top sides of the cup and connected thereto by a narrow transition panel. The frame panels may be cut to provide a maximum stretch along the outer edge of the cup, maximum stretch traverse to the inner edge of the cup, and maximum multi-directional stretch in the area above the top of the cup. The transition panel has an open pattern and is hingable about an axis parallel to the edge of the cup. The distensible frame panels and the transition panel isolate the cup from the top elastic bands or yoke which run along the outer edge of the frame panel. The bottom frame portion may include non-distensible panels by themselves or in combination with an underwire.

Other objects, advantages and novel features of the present invention will become apparent from the detailed description of the invention when considered in conjunction with the accompanying drawings.

DESCRIPTION OF THE PREFERRED EMBODIMENTS

Figure 1:
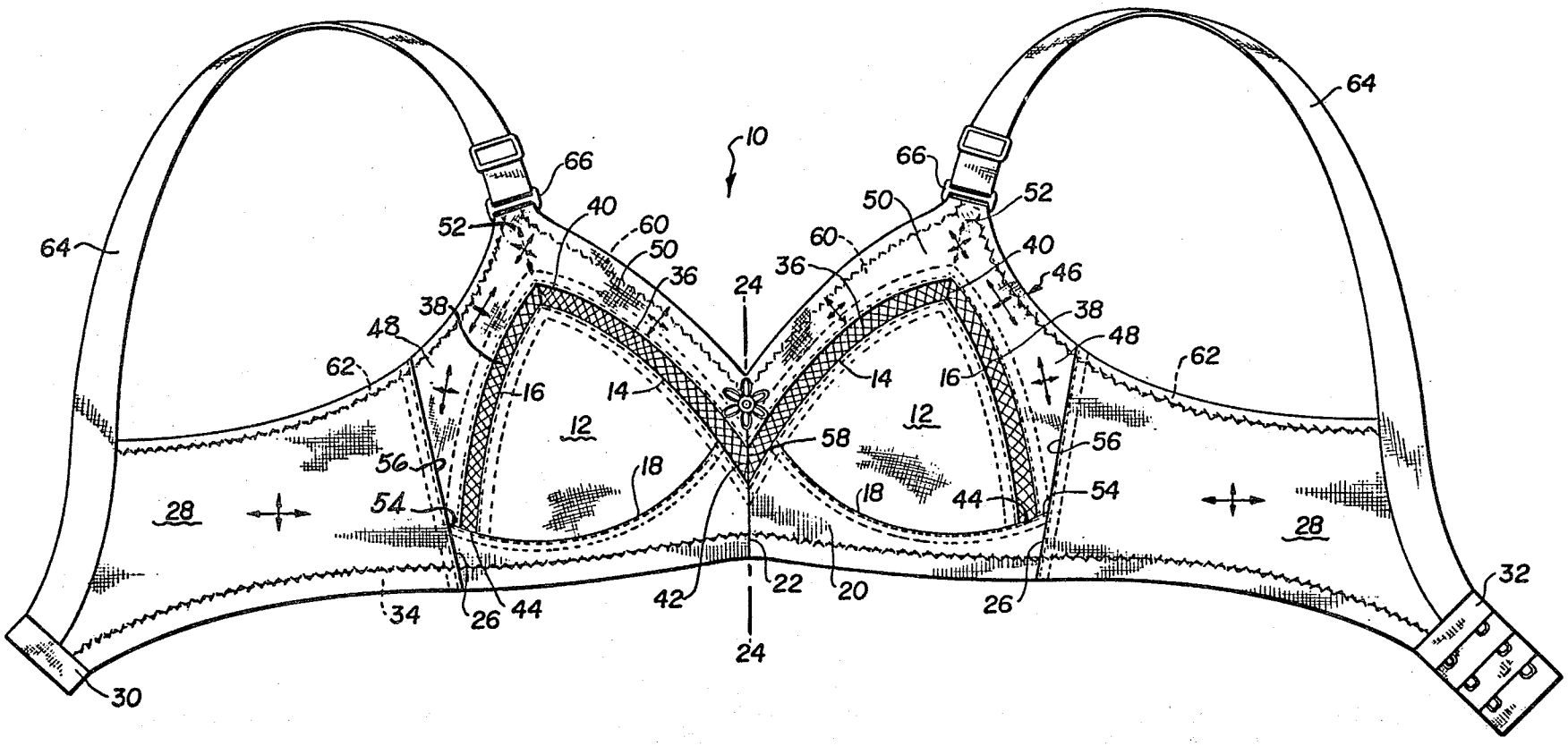
FIG. 1 is a front elevational view of a brassiere incorporating the principles of the present invention.
Figure 2:
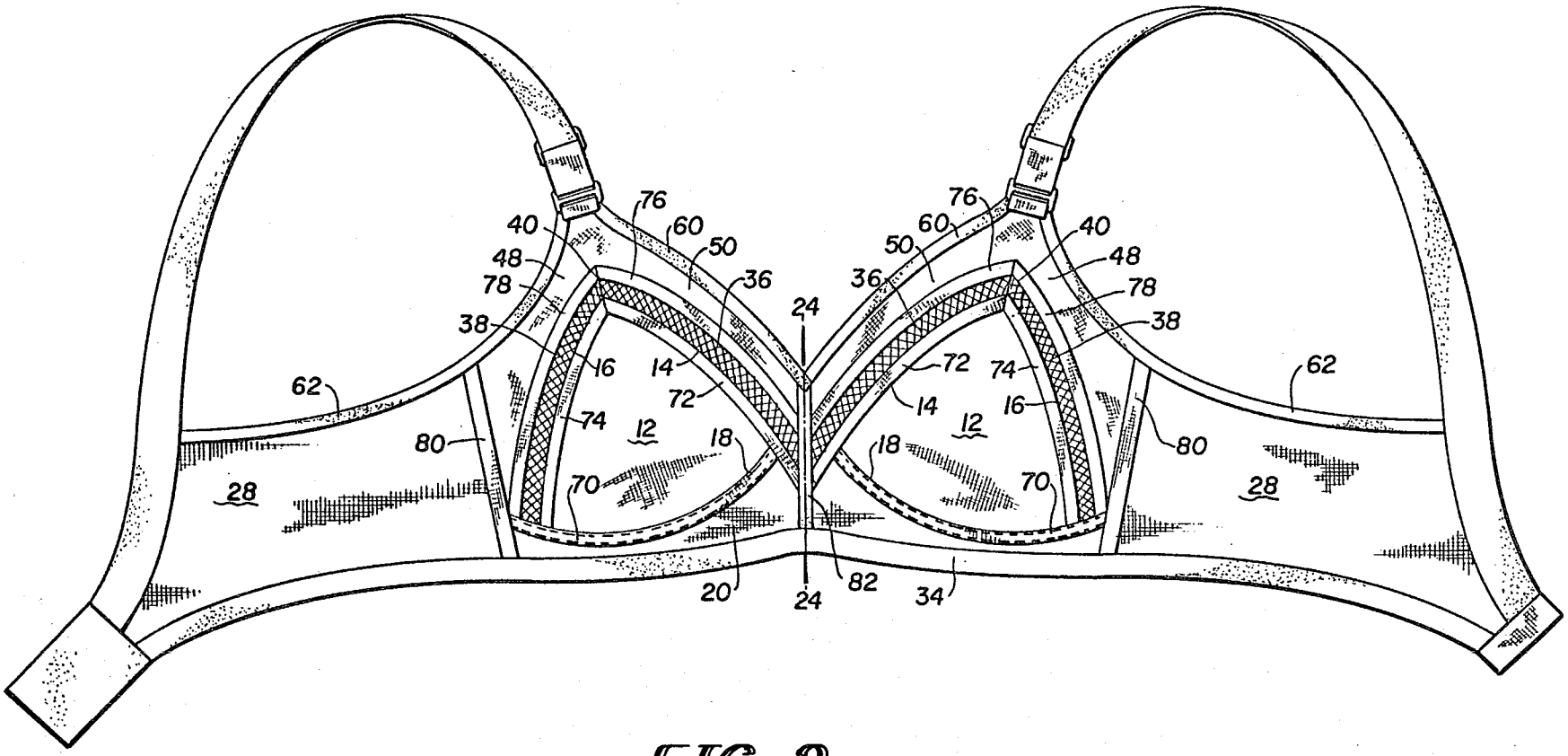
FIG. 2 is a rear elevation of the brassiere of FIG. 1.

A brassiere 10 as illustrated in FIGS. 1 and 2 includes a pair of breast cups 12 each having an inner edge 14, an outer edge 16 and a bottom edge 18. The cup 12 as illustrated is a seamless molded cup, but if desired may be a sewn cup formed from two or more pieces into a general conical shape. The cups 12 are formed of substantially non-distensible material, for example, a simplex style warp knit of polyester whose distensibility is reduced by molding. The distensibility of the cup should be minimized to provide maximum support of the individual breasts, although some distensibility such as the natural give of a fabric which increases comfort is desired. Compared to the cup frame, to be described below, the cups are considered substantially non-distensible. Connected directly to the bottom edge 18 of the cup and extending laterally beyond the inner and outer edges 14 and 16, respectively, of the cup is a bottom framing panel 20. The bottom framing panels 20 are connected at their inner lateral edges 22 along a vertical medial line 24. At their outer lateral edges 26, the bottom panels 20 are connected to a respective body-encompassing or dorsal panel 28. Complementary fasteners 30 and 32, for example, hooks and eyes are provided at the other lateral edge of the dorsal or body-encompassing panels 28.

As illustrated by the relative size of the crossed arrows, the body-encompassing or dorsal panels 28 are formed from multi-directional stretchable and distensible material having greater distensibility in the horizontal direction. This is to accommodate the variations of the body in the horizontal directions resulting from movement or breathing. An elastic band 34, best seen in FIG. 2, extends along the bottom of the bottom framing panels 20 and the body-encompassing panels 28 and are attached thereto by zigzag stitching. The non-distensible bottom panel 20 restricts the distensibility of the elastic band 34 below the cup.

Connected along the inner edge 14 of cup 12 is a transition panel 36 and connected along the outer edge 16 of the cup 12 is a transition panel 38. The transition panels 36 and 38 are joined by stitching at an apex 40. The lower end of transition panel 36 is connected together at 42 along the vertical medial line 24. The lower end of transition panel 38 is joined to the bottom panel 20 at 44. The transition panels 36 and 38 are an open patterned material and are illustrated as a lace. The panels 36 and 38 have an orientation such that they will readily fold or hinge about an axis parallel to the respective edges 14 and 16 of the cup. This allows the cup and the transition panels to follow the contour of the breast extending from the plane of the chest without the puckering of prior art brassieres. The open pattern is also capable of a limited amount of give along other axes. Although it is preferred that the transition panels 36 and 38 be non-distensible so as to provide a first type of transition from the non-distensible cup 12, these transition panels may be of distensible material. Since the panels 36 and 38 are relatively narrow, the degree of distensibility is somewhat limited even if they were made from distensible material.

Encompassing the transition panels 36 and 38 is an upper distensible frame 46 having a substantially inverted V-shape with an outer leg 48 and inner leg 50 which meet at an apex portion 52. The outer leg 48 is connected at its lower edge 54 to the bottom panel 20 and at its lateral outer edge 56 to the dorsal or body-encompassing panel 28. The inner legs 50 of the frame 46 are connected at their respective inner lateral edges 58 along the vertical medial line 24. Attached along the top outer edge of inner leg 50 by zigzag stitching is an elastic band 60 as best seen in FIG. 2. Extending along the top outer edge of the outer frame leg 48 and the top outer edge of the dorsal or body-encompassing panel 28 attached thereto by zigzag stitching is an elastic band 62. A shoulder strap 64 connected to the dorsal or body-encompassing panel 28 is also connected to the apex portion 52 of the framing member by a loop 66.

The upper frame member 46 is formed from a multi-directional stretchable material cut to have specific distensible characteristics along different areas thereof. As in most multi-directional stretchable materials, there is a major axis of distensibility and a minor axis of distensibility. The amount of distensibility is a function of the process used in forming the material be it weaving or knitting as well as the materials or yarns used. Similarly restriction of the distensibility may be produced by narrowing the given area in a specific direction. As indicated by the arrows in FIG. 1, the material for the upper frame 46 is cut to have the maximum direction of distensibility parallel to the outer edge 16 of the cup 12. This is illustrated by the extremely long arrow in outer leg 48 of the frame 46. By necking down or forming a narrow portion adjacent the top outer edge in outer leg 48, the distensibility perpendicular to the edge 16 of the cup in this area is substantially reduced. This is noticeable by comparing the arrows adjacent the upper portion of outer leg 48 with the arrows of the lower portion adjacent the outer lateral edge 56. It should be noted that the apparent rotation of the arrows along edge 16 results from a planar representation of a three dimensional object; i.e. the orientation of the material follows the edge 16 of the cup.

By the specific layout of the material in the outer leg 48, additional horizontal forces from the body-encompassing or dorsal panel 28 may be dissipated in the portion adjacent the lateral edge 56 of the leg 48. Vertical or non-horizontal forces produced by raising the arm or other motions are dissipated by the leg 48 along an axis parallel to the edge 16 of the cup 12. By limiting the distensibility adjacent the outer-upper portion of edge 16 of the cup, needed support is not compromised by the ability to dissipate non-horizontal forces.

The material of the frame 46 is such that for the inner leg 50, the major stretch axis as indicated by the arrows is traverse to the inner edge 14 of the cup 12. The minor stretch axis is not restricted by the cut of the material as indicated by the arrows. The distensibility of the material is such that the leg 50 will accommodate the force traverse to the edge 14 produced by variations of the volume and geometric shape of the breasts as well as minor forces produced by the shoulder straps along the axis of the edge 14.

As will be described below in reference to FIG. 2, a non-distensible strip 82 is provided to restrict vertical distensibility along the medial line 24. The arrow at the juncture of the inner legs 50 indicates that the major stretch at the juncture is substantially horizontal. This allows maximum individual adjustment of the cups horizontally relative to the medial line 24 to accommodate for non-symmetric breast size and spacing and thereby greatly increases the comfort to the wearer, while providing support. Similarly, the inner legs 50 and transition panel 36 distribute the forces produced by the non-symmetry of the wearer. This allows the straps to be individually adjusted without causing an undesirable shifting of the other cup. Similarly, the bottom of the cup does not ride up with strap adjustment.

The apex portion 52 of the upper frame panel 46 is free from restriction and is stretchable in multi-directions. This isolates the apex of the cup 12 from all stresses produced at the attachment of the shoulder strap 64 to the upper frame 46. These stresses are a major cause of the forces along the inner and outer edges 14 and 16 of the cup 12 to produce the puckered configuration of the prior art brassieres. In prior art devices, the stitch in this area or an overlap panel was provided to produce the required support of the total cup 12 and thereby also produced a total transmission of the forces from the shoulder strap 64 to the cup. The present frame 46 is shaped, cut and secured so that the support is provided adjacent the top outer edge of edge 16 and not in the area between the apex of the cup 12 and shoulder strap 64. The solid arrows indicate the axis of stretch of the material and the dashed arrow representing the give along the bias.

To further define the dissipation of forces as well as the even distribution of forces along specific lines, all of the juncture of the panels and cups are lined with a non-distensible ribbon or strip. As illustrated more specifically in FIG. 2, a non-distensible strip 70 is connected across the juncture of the bottom edge 18 of the cup 12 and the non-distensible bottom panel 20. Non-distensible strips 72 and 74 are along the juncture of the edges 14 and 16 of the cup and transition panels 36 and 38, respectively. Non-distensible strips 76 and 78 are attached along the juncture of the transition panels 36 and 38 and the legs 50 and 48, respectively, of the frame 46. Non-distensible strip 80 is along the juncture of the body-encompassing or dorsal panel 28 and the outer frame legs 48. A non-distensible strip 82 runs along the vertical medial line 24 and restricts the vertical distensibility of the panels joined along the medial line 24. As can be seen from FIG. 2, the non-distensible strip 78 in combination with the elastic band 62 further restricts the width of the outer frame leg 48 adjacent the upper outer edge 16 of the cup.

The different distensible characteristics of the outer frame 46 provide varying degrees of transition between the non-distensible cup 12 and the elastic bands 60 and 62 or the yoke of the frame. The outer frame 46 having legs 48, 50 and apex 52 is a multi-directional distensible material which allows for dissipation of stresses while having a somewhat controlled distensibility to provide appropriate support. The transition panels 36 and 38 allow for volumetric change in the size of the bust as well as difference in the distance of separation between breasts for different wearers and provides a smooth transition between the upper edges of the cup and the surface of the chest. The combination of the transition panels 36 and 38 and the distensible material of legs 48, 50 and 52 provide a unique combination of materials and characteristics to provide an improved comfort support frame for a substantially non-distensible breast cup. The use of non-distensible strips or bands along the juncture of the panels provides for even distribution of stresses along the juncture. The non-distensible bottom panel 20 and the non-distensible strip 82 along the vertical medial line 24 maximizes the support for the weight of the breast.

Figure 3:
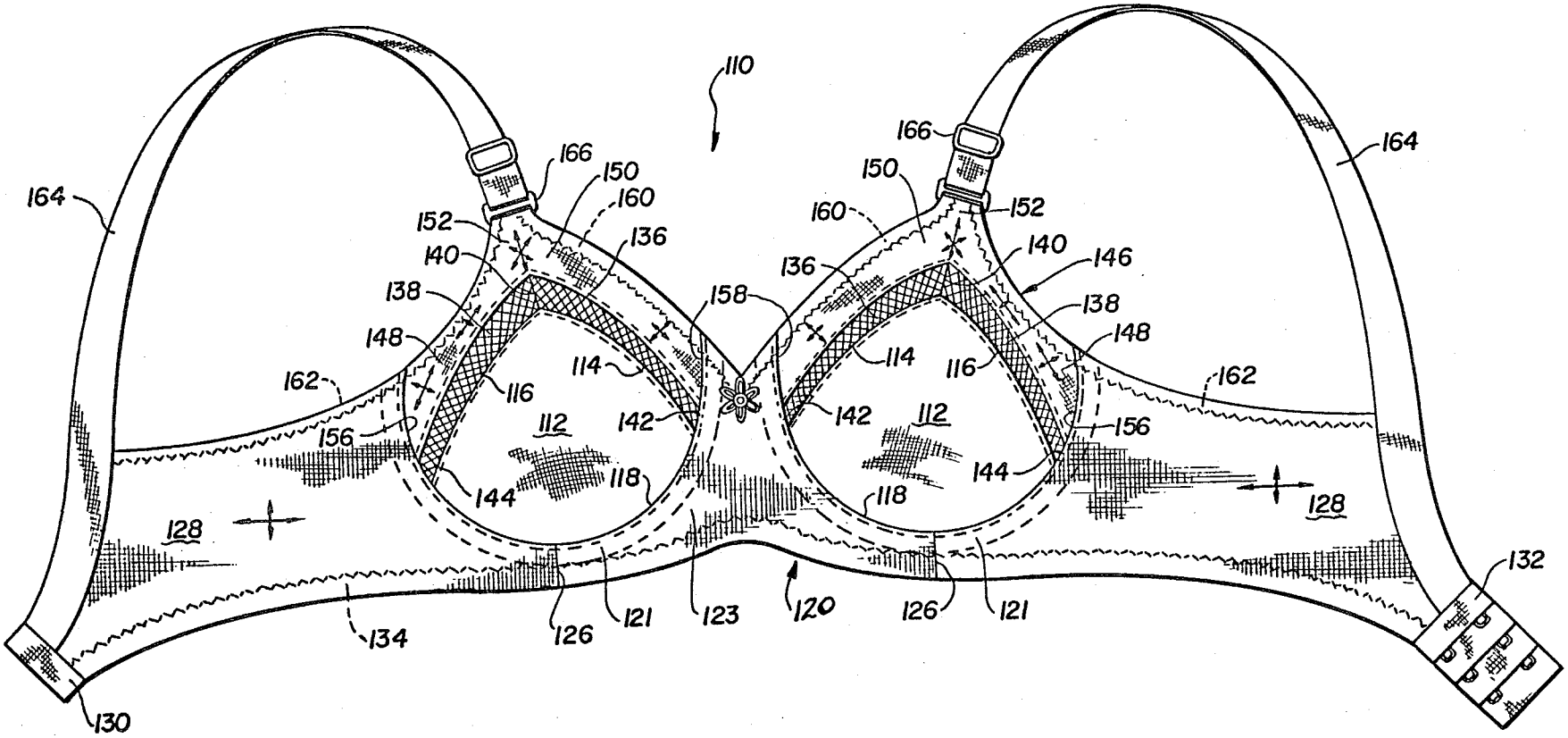
FIG. 3 is a front elevational view of a brassiere having an underwire incorporating the principles of the present invention.
Figure 4:
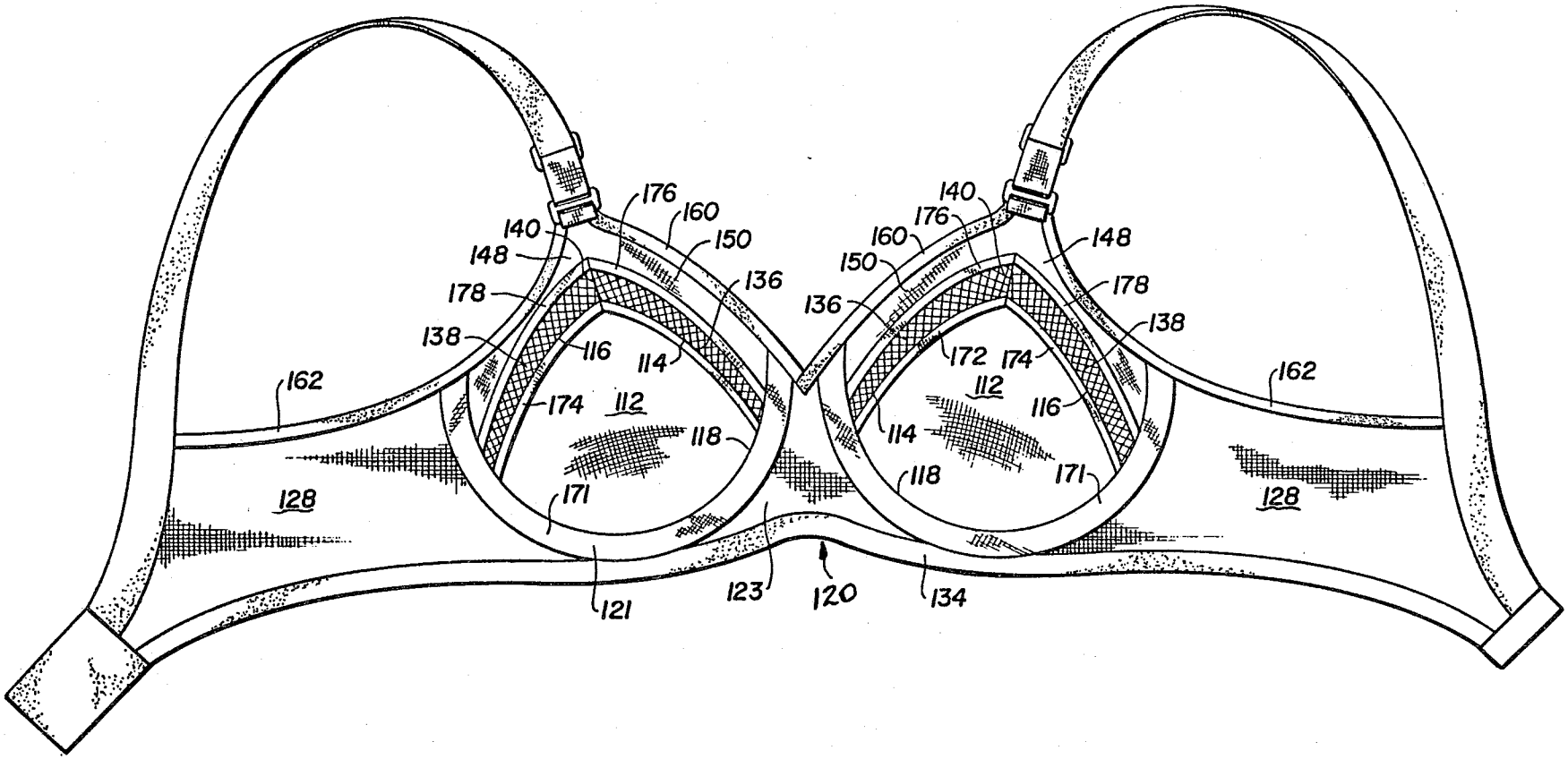
FIG. 4 is a rear elevation of the brassiere of FIG. 3.

A brassiere 110 incorporating an underwire is illustrated in FIGS. 3 and 4. The design philosophy is the same as that for the brassiere 10 of FIGS. 1 and 2. The elements of FIGS. 3 and 4 that are substantially identical to those of FIGS. 1 and 2 and perform the same function will have the same number plus 100.

The brassiere 110 includes a pair of breast cups 112 preferably of substantially non-distensible material each having an inner edge 114, an outer edge 116 and a bottom edge 118. Connected directly to the bottom edge 118 of the cup and extending laterally beyond the inner and outer edges 114 and 116, respectively, of the cup is a bottom framing element 120. The bottom framing portion 120 includes an underwire structure 121 connected directly to the bottom edge 118 of the cup and a non-distensible center panel 123 extending between adjacent inner segments of the underwire structures 121 at the center of the brassiere.

Body-encompassing or dorsal panels 128 are connected to the outer lateral edges 126 of the center panel 123 and the outer segment of underwire structures 121. Complementary fasteners 130 and 132, for example, hooks and eyes are provided at the other lateral edge of the dorsal or body-encompassing panels 128. The body-encompassing or dorsal panels 128 are formed preferably from multi-directional stretchable and distensible material having greater distensibility in the horizontal direction. An elastic band 134 extends along the bottom of the center framing panels 123 and the body-encompassing panels 128 and are attached thereto by zigzag stitching. The non-distensible bottom center panel 123 restricts the distensibility of the elastic band 134 below the cup.

Connected along the inner edge 114 of cup 112 is a transition panel 136 and connected along the outer edge 116 of the cup 112 is a transition panel 138. The transition panels 136 and 138 are joined by stitching at an apex 140. The lower end of transition panels 136 and 138 are connected to the underwire structure 121 at 142 and 144, respectively. The transition panels 136 and 138 are an open patterned material and perform the same function as transition panels 36 and 38 in FIGS. 1 and 2.

Encompassing the transition panels 136 and 138 is an upper distensible frame 146 having a substantially inverted V-shape with an outer leg 148 and inner leg 150 which meet at an apex portion 152. The outer leg 148 and the outer leg 150 are connected at their lateral edges 156 and 158, respectively, to the underwire structure 121. Thus, the underwire structure 121 is connected to the bottom of the cup 112 and the lateral edges of the upper framing member 146. Attached along the top outer edge of inner leg 150 by ziqzag stitching is an elastic band 160. Extending along the top outer edge of the outer frame leg 148 and the top outer edge of the dorsal or body-encompassing panel 128 attached thereto by zigzag stitching is an elastic band 162. A shoulder strap 164 connected to the dorsal or body-encompassing panel 128 is also connected to the apex portion 152 of the framing member by a loop 166.

The material of frame 146 and how it is cut is the same as that of frame 46 of FIGS. 1 and 2 so as to perform the same functions.

As illustrated in FIG. 4, the underwire brassiere 110 includes less seams than the brassiere 10 of FIG. 2. The underwire structure 121 includes a single non-distensible strip 171 connected across the junctures of the bottom edge 118 of the cup, lateral edges 142 and 144 of transition panels 136 and 138, and lateral edges 156 and 158 of frame to the center framing panel 123 and body-encompassing or dorsal panel 128. A rigid wire (not shown) is provided in the pocket formed by strip 171. Strip 171 takes the place of strips 70 and 80 of the brassiere 10 of FIG. 2. Since the center framing panel 123 is non-distensible and formed as a single member, non-distensible strip 82 of FIG. 2 is eliminated. Non-distensible strips 172 and 174 are along the juncture of the edges 114 and 116 of the cup and transition panels 136 and 138, respectively. Non-distensible strips 176 and 178 are attached along the juncture of the transition panels 136 and 138 and their legs 150 and 148, respectively, of the frame 146.

The brassiere 110 of FIGS. 3 and 4 functions substantially identical to brassiere 10 of FIGS. 1 and 2 to provide support, comfort and adjustability with the exception that the center portion of brassiere 110 has no lateral or horizontal stretch or distensibility. The underwire structure 121 and the non-distensible center framing panel 123 provide rigid structure to support and uplift the base of the breast. This additional support does not affect the adjustability and force dissipation of the frame 146 and the transition panels 136 and 138.

Figure 5:
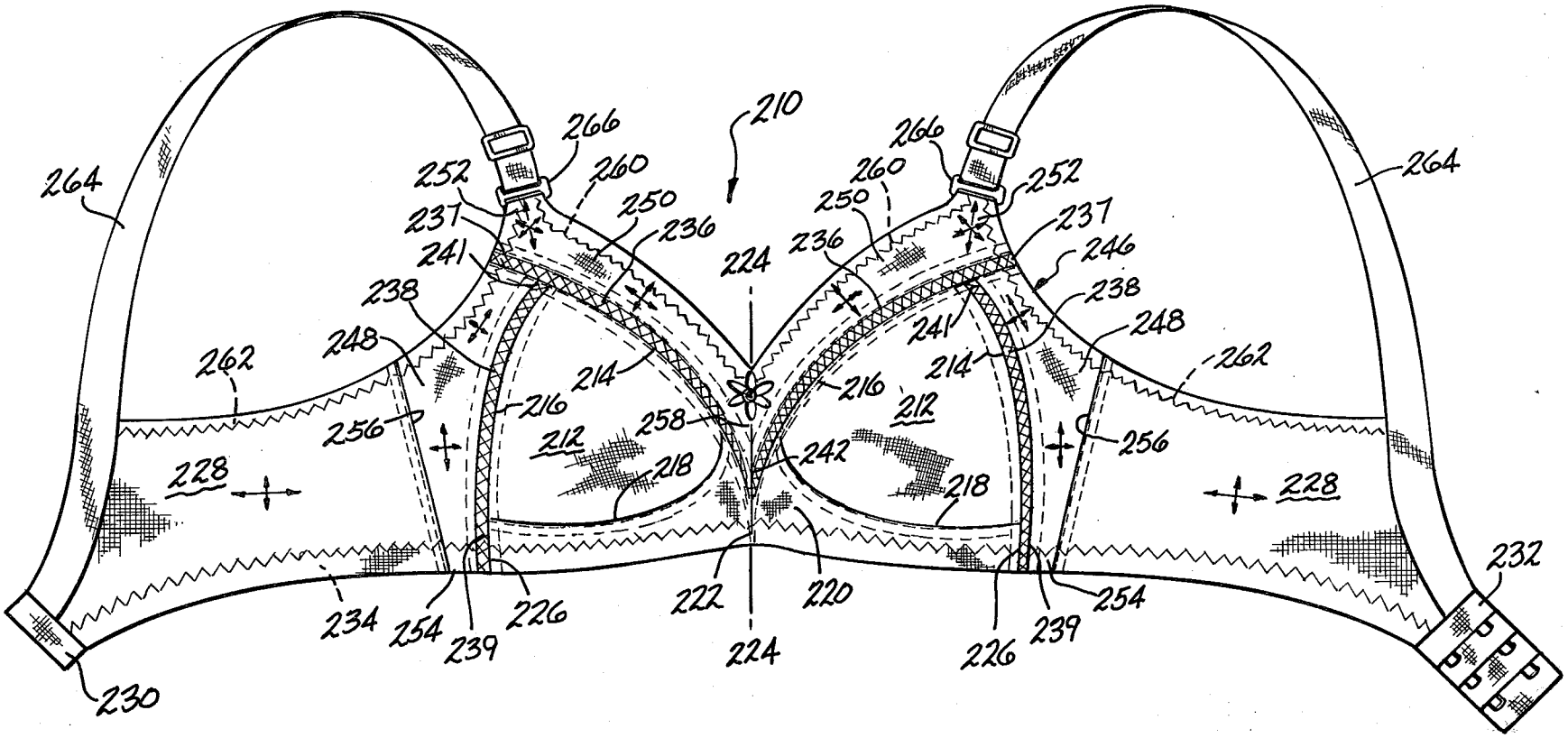
FIG. 5 is a front elevational view of an alternative embodiment of the invention shown in FIG. 1.
Figure 6:
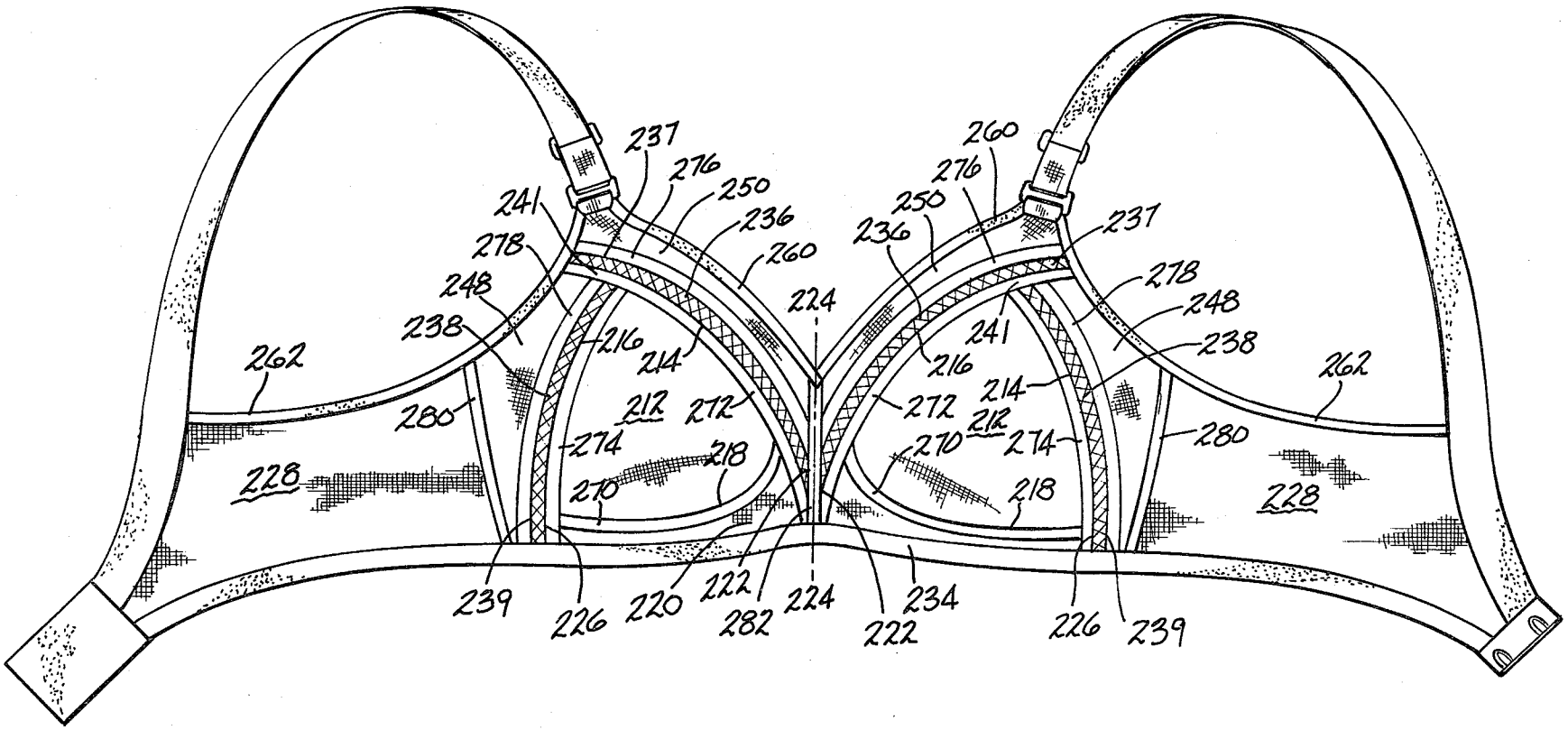
FIG. 6 is a rear elevation of the brassiere of FIG. 5.

A brassiere 210, illustrated in FIGS. 5 and 6, is similar to brassiere 10 but incorporates modifications and variations within the scope and spirit of this invention. The basic design philosophy is the same as that for brassiere 10. The elements of FIGS. 5 and 6 that are substantially identical to those of FIGS. 1 and 2 and perform the same function will have the same numbers plus 200.

The brassiere 210 includes a pair of breast cups 212, preferably made of a substantially non-distensible material, each having an inner edge 214, an outer edge 216 and a bottom edge 218. Connected directly to the bottom edge 218 of the cup is a non-distensible bottom framing panel 220. The bottom panels 220 are connected at their inner lateral edges 222 along a vertical medial line 224. At their outer lateral edges 226, the bottom panels 220 are connected to a lower extended segment 239 of a transition panel 238 as further described herein. The outer edge of the transition panel 238 is connected to an outer frame panel 248 of a distensible frame 246 further described herein. Body encompassing or dorsal panels 228 are connected to the outer lateral edges 226 of the outer frame panels 248. The dorsal panels 228 are formed preferably from multidirectional stretchable and distensible material having greater distensibility in the horizontal direction. Complementary fasteners 230 and 232, for example, hooks and eyes are provided at the other lateral edge of the dorsal panels 228. An elastic band 234, best seen in FIG. 6, extends along the bottom framing panels 220 and the dorsal panels 228 and are attached thereto by zigzag stitching. The non-distensible bottom panel 220 restricts the distensibility of the elastic band 234 below the cup 212.

Connected substantially along the inner edge 214 of cup 212 is a transition panel 236 and connected substantially along the outer edge 216 of the cup 212 is the transition panel 238. As best seen in FIG. 6, the transition panels 236 and 238 are joined by a non-distensible strip 272 at 241 adjacent the apex of the cup 212. Alternatively, the transition panels 236, 238 may be joined together by stitching at the juncture therebetween as in brassiere 10 shown in FIGS. 1 and 2. Extended below and adjacent the bottom edge 218 of the cup 212 is the extended transition segment 239 of the transition panel 238 which extends the transition panel 238 to the bottom elastic band 234. The segment 239 interconnects the non-distensible bottom framing panel 220 to the distensible frame panel 248. The inner transition panel 236 has an extended segment 237 which extends the transition panel 236 above the outer edge 216 of the cup 212 to a top, outer elastic band 262. The extended segment 237 interconnects the outer frame panel 248 and an inner frame panel 250, as further described herein. The transition panels 236 and 238 are preferably made of an open patterned material having an orientation such that they will readily fold or hinge about an axis parallel to the respective edges 214 and 216 of the cup 212. The open pattern is also capable of give along other axes. The transition panels 236 and 238 perform the same function as transition panels 36 and 38 of FIGS. 1 and 2, in addition to interconnecting the outer and inner frame panels 248, 250 and the outer frame panel 248 and the bottom framing panel 220, respectively.

Substantially encompassing the transition panels 236 and 238 is the distensible frame 246 including the outer frame panel 248 and the inner frame panel 250 having an apex portion 252. The outer frame panel 248 is connected at its lower edge 254 to the bottom elastic band 234 and at its lateral edge 256 to the dorsal panel 228. Extending along the top outer edge of the dorsal panel 228, the outer frame panel 248, the extended segment 237 and the apex portion 252 of the inner frame panel 250, and attached thereto by zigzag stitching is an elastic band 262, as best seen in FIG. 6. The inner frame panels 250 are connected at their respective inner lateral edges 258 along the vertical medial line 224. Attached along the top inner edge of the inner frame panel 250 by zigzag stitching is an elastic band 260, as best seen in FIG. 6. The inner and outer frame panels 248, 250 are joined together by the extended segment 237 of the inner transition panel 236 and additionally by non-distensible strips 272 and 276, further discussed herein. The apex portion 252 of the inner frame panel 250 is connected to a loop 266 which in turn is connected to one end of a shoulder strap 264. The other end of the strap 264 is connected to the dorsal panel 228.

The material of the frame 246 and how it is cut is the same as that of frame 46 of brassiere 10 so as to perform the same functions. That is, the brassiere 210 with its two frame panels 248 and 250 interconnected by the extended transition segment 237 functions in the same or similar fashion as brassiere 10 since the frame 246 is stretchable in multi-directions and forces relieved by frame 246 are transmitted between frame panels 248 and 250 comparable to the one piece frame 46 of brassiere 10. It is preferable to have maximum direction of distensibility parallel to the outer edge 216 enabling horizontal forces from the dorsal portion 228 to be dissipated in the portion adjacent the lateral edge 256 of the outer frame panel 248 and non-horizontal forces to be dissipated by the outer frame panel 248 along an axis parallel to the edge 216 of the cup 212. Further, the distensibility of the material of the inner frame panel 250 is preferably such that it will accommodate forces traverse to the edge 214 of the cup 212 produced by variations of the volume and geometric shape of the breast. Lastly, the apex portion 252 of the inner frame panel 250 is still substantially free from restriction and is stretchable in multi-directions to isolate the apex of the cup 212 from all stresses produced at the attachment of the shoulder strap 264 to the upper frame 246.

As illustrated in FIG. 5, all of the junctures of the panels and cups are lined with non-distensible ribbon or strips to further define the dissipation of forces as well as to provide the even distribution of forces along specific lines. A non-distensible strip 270 is connected across a juncture of the bottom edge 218 of the cup 212 and the non-distensible bottom panel 220. A non-distensible strip 272 is connected along the juncture of the edge 222 of the bottom framing panel 220, the edge 214 of cup 212, the edge of the transitional panel 238, the edge of the outer frame panel 248, and the edge of the transitional panel 236. A non-distensible strip 274 is connected along the juncture of edge 216 of cup 212, the lateral edge 226 of bottom framing panel 220 and the edge of transition panel 238. Non-distensible strips 276 and 278 are attached along the juncture of the transition panels 236 and 238 and the inner frame panel 250 and outer frame panel 248, respectively. A non-distensible strip 280 is connected along the juncture of the body encompassing or dorsal panel 228 and the outer frame panel 248. A non-distensible strip 282 runs along the vertical medial line 224 and restricts the vertical distensibility of the panels joined along the medial line 224.

In summary, the brassiere 210 of FIGS. 5 and 6 functions substantially identical to the brassiere 10 of FIGS. 1 and 2 to provide support, comfort and adjustability. The more significant modifications of the brassiere 10 incorporated into brassiere 210 include the multi-frame panels 248 and 250 which are interconnected by the extended segment 237 of the transition panel 236, the extended segments 239 of transition panels 238 and relative spacing between the bottom framinq portion 220 and the dorsal panels 228. These modifications can simplify construction and permit some artistic latitude in making a bra frame wherein the non-distensible breast cups are isolated from the distensible multi-directional frame as described above.

Other modifications and variations are implicitedly suggested herein and are considered to be within the scope of this invention. For example, the interconnecting of panels 248 and 220 may be alternatively provided by eliminating the extended segment 239 and directly joining the panels 248 and 220 as in, for example, brassiere 10 shown in FIGS. 1 and 2. Further, the frame panels 248 and 250 of the distensible frame 46 may be directly joined together by eliminating extended segment 237 and upwardly extending frame panel 248 or downwardly extend frame panel 250. Alternatively, a plurality of frame panels can be sewn together, or the extended segment 237 can be eliminated and transition panel 238, as opposed to transition panel 236, can be extended to interconnect a plurality of distensible frame panels, in all cases maintaining the function of the distensible multi-directional frame 246 in relation to the non-distensible cup 212 as detailed above. Lastly, an underwire bra comparable to brassiere 110 incorporating the multi-frame panel concept of brassiere 210 is likewise within the scope of this invention and may also be desirable for artistic or ease of construction purposes.

From the preceding description of the preferred embodiments, it is evident that the objects of the invention are attained in that an improved brassiere is provided having maximum dissipation of forces without compromise of support. Although the invention has been described and illustrated in detail, it is clearly understood that the same is by way of illustration and example only and is not to be taken by way of limitation. The spirit and scope of the present invention are to be limited only by the terms of the appended claims.

What is claimed:

1. A brassiere comprising:

two breast receiving cups each having an inner edge, an outer edge, and a bottom edge;

cup framing means peripherally extending about said cups;

body encircling means affixed laterally outward of said framing means;

shoulder straps extending upward of said cup framing means;

said cup framing means comprising:

a non-stretchable bottom portion connected directly to said bottom edge of a respective cup, and secured at its outer edge to a respective body encircling means;

a plurality of frame panels of multi-directional stretchable material for each cup extending along the inner and outer edge of said cups; and transition means interconnecting said frame panels and the inner and outer edge of said cup for providing a transition between the cup and the multi-directional stretchable frame panels.

2. The brassiere according to claim 1 wherein said transition means includes a non-stretchable open material hingable along axis parallel to the edge of said cup.

3. The brassiere according to claim 1 wherein said transition means includes open material hingable along axis parallel to the edge of said cup.

4. The brassiere according to claim 3 wherein said open material is stretchable only along an axis perpendicular to the edge of said cup.

5. The brassiere according to claim 1 wherein said transition means comprises at least one transition panel for each cup, said transition panel of each cup extending below said bottom edge of said cup.

6. The brassiere according to claim 1 wherein said transition means comprises at least one transition panel for each cup wherein said transition panel interconnects said plurality of frame panels.

7. The brassiere according to claim 6 wherein said frame panels comprise an inner frame panel and an outer frame panel, said inner and outer frame panels interconnected by said transition panel.

8. The brassiere according to claim 1 wherein said plurality of frame panels comprises an inner frame panel extending along the inner edges of said cups and an outer frame panel extending along the outer edges of said cups.

9. The brassiere according to claim 8 wherein said inner and outer panel is cut so that the portion adjacent said outer edge of said cup is more readily stretchable along an axis substantially parallel to the outer edge of said cup and the portion adjacent said inner edge of said cup is more readily stretchable along an axis substantially perpendicular to the inner edge of said cup.

10. The brassiere according to claim 8 wherein said inner and outer frame panel is narrow adjacent the top portion of the inner and outer edges of said cup to restrict the stretching in these regions to provide support and the portion of said frame panels between the top of the cup and the attachment of the shoulder straps is freely stretchable.

11. The brassiere according to claim 1 wherein said bottom portion extends laterally beyond the inner and outer edges of said cups.

12. The brassiere according to claim 1 wherein said bottom portion comprises an underwire extending along the bottom edge of said cup and the lateral edge of said frame panels.

13. The brassiere according to claim 12 wherein said bottom portion further comprises a non-stretchable panel extending between the adjacent segments of said underwires.

14. The brassiere according to claim 13 wherein said body encircling means are connected to said underwires.

15. The brassiere according to claim 1 including means for restricting vertical movement along a vertical medial line between each cup.

16. The brassiere comprising:

two breast receiving cups of substantially non-distensible material, each having an inner edge, an outer edge, and a bottom edge;

cup framing means peripherally extending about said cups;

body encircling means affixed laterally outward of said framing means;

shoulder straps extending upward of said cup framing means;

a bottom portion of said cup framing means connected to the bottom edge of a respective cup and said bottom portion being non-distensible;

a base elastic band attached along the bottom edge of said bottom portion and of said body-encompassing means, said bottom panel restricting the distensibility of said base elastic band below said cups;

a pair of top elastic bands attached along the upper edge of said framing means of each cup and terminating at one end at the area to which the shoulder strap is attached to said framing means;

a first transition panel connected along the inner and outer edge of a respective cup;

a plurality of second transition panels connected between said first transition panel and said top elastic bands;

said first and second transition panels having different distensible characteristics from each other and from said base elastic band and said cup to isolate the cups and the top elastic bands from each other.

17. The brassiere according to claim 16 wherein said first transition panel includes a non-stretchable open material hingable along axes parallel to the edge of said cup.

18. The brassiere according to claim 16 wherein said first transition panel includes open material hingable along axes parallel to the edge of said cup.

19. The brassiere according to claim 18 wherein said open material is stretchable only along any axis perpendicular to the edge of said cup.

20. The brassiere according to claim 16 wherein said transition panel extends below said bottom edge of said cup.

21. The brassiere according to claim 16 wherein said first transition panel comprises at least one transition segment to interconnect said plurality of second transition panels.

22. The brassiere according to claim 21 wherein said plurality of second transition panels comprises an inner frame panel and an outer frame panel, said inner and outer frame panels interconnected by said at least one transition segment.

23. The brassiere according to claim 16 wherein said plurality of second transition panels comprises an inner frame panel extending along the inner edge of said cups and an outer frame panel extending along the inner edge of said cups and an outer frame panel extending along the outer edge of said cups.

24. The brassiere according to claim 23 wherein said second transition panels comprises a plurality of pieces of material cut so that the portion adjacent said outer edge of said cup is more readily stretchable along an axis substantially parallel to the outer edge of said cup and the portion adjacent said inner edge of said cup is more readily stretchable along an axis substantially perpendicular to the inner edge of said cup.

25. The brassiere according to claim 23 wherein said plurality of second transition panels are narrow adjacent the top portion of the inner and outer edges of said cup to restrict the stretching in these regions to provide support and the portion of said second transition panels between the top of the cup and the attachment of the shoulder straps is freely stretchable.

26. The brassiere according to claim 16 wherein said bottom portion extends laterally beyond the inner and outer edges of said cups.

27. The brassiere according to claim 16 wherein said bottom portion of said framing means comprises an underwire extending along the bottom edge of said first and second transition panels.

28. The brassiere according to claim 27 wherein said bottom portion of said framing means further comprises a non-stretchable panel extending between the adjacent segments of said underwires.

29. The brassiere according to claim 28 wherein said body encircling means are connected to said underwires.

* * * * *

UNITED STATES PATENT AND TRADEMARK OFFICE

CERTIFICATE OF CORRECTION

PATENT NO. : 4,444,192

DATED : April 24, 1984

INVENTOR(S) : Harold Stern et al.

It is certified that error appears in the above-identified patent and that said Letters Patent is hereby corrected as shown below:

The term of this patent subsequent to Feb. 8, 2000 has been disclaimed.

Signed and Sealed this

*Fourth* Day of *September 1984*

[SEAL]

*Attest:*

GERALD J. MOSSINGHOFF

*Attesting Officer*

*Commissioner of Patents and Trademarks*